US007270243B2

(12) United States Patent
Diehl

(10) Patent No.: US 7,270,243 B2
(45) Date of Patent: Sep. 18, 2007

(54) METHOD FOR ERECTING AN AT LEAST TWO-PIECE MAIN BOOM FOR A LATTICE-BOOM CRANE AND LATTICE-BOOM CRANE BUILT ACCORDINGLY

(75) Inventor: Stefan Diehl, Homburg/Saar (DE)

(73) Assignee: Terex-Demag GmbH & Co. KG, Zweibrucken (DE)

( * ) Notice: Subject to any disclaimer, the term of this patent is extended or adjusted under 35 U.S.C. 154(b) by 0 days.

(21) Appl. No.: 11/233,981

(22) Filed: Sep. 23, 2005

(65) Prior Publication Data

US 2006/0065616 A1 Mar. 30, 2006

Related U.S. Application Data

(63) Continuation of application No. PCT/EP2004/003223, filed on Mar. 26, 2004.

(60) Provisional application No. 60/459,669, filed on Apr. 2, 2003.

(51) Int. Cl.
*B66C 23/42* (2006.01)

(52) U.S. Cl. ..... 212/270; 212/300

(58) Field of Classification Search ..... 212/168, 212/300, 270, 239, 262
See application file for complete search history.

(56) References Cited

U.S. PATENT DOCUMENTS 1,920,370 A * 8/1933 Forsythe et al. ..... 212/177
2,649,210 A * 8/1953 Marchese ..... 212/300
2,874,851 A * 2/1959 Scheuerpflug ..... 212/300
3,028,018 A * 4/1962 Mott ..... 212/300
3,794,184 A 2/1974 Higgins
4,828,124 A * 5/1989 Iga ..... 212/300
5,140,929 A * 8/1992 Gaspard ..... 212/270

(Continued)

FOREIGN PATENT DOCUMENTS

DE 3042287 A1 6/1982

(Continued)

OTHER PUBLICATIONS

"Austrian Search Report for Application No. 5 160 000", 4 Pages.

(Continued)

*Primary Examiner*—Thomas J. Brahan
(74) *Attorney, Agent, or Firm*—Schwegman, Lundberg, Woessner and Kluth P.A.

(57) ABSTRACT

The present invention substantially relates to a method for erecting and disassembling an at least two-piece main boom for a lattice-boom crane. The erecting and disassembling procedure results in that the geometric kinematic properties of the main boom (1, 2) are used in such a manner that during the erecting and disassembling, the effective lever arm (1') of the main boom (1, 2) is reduced. This results from the main boom (1, 2) being bent at the hinge point (A), at which at least two boom portions (1, 2) are connected to each other, and thus an angle position is produced between the two boom portions (1, 2). Further, the invention relates to a main boom (1, 2), which can be erected by the method as well as a lattice-boom crane having such an main boom (1, 2).

24 Claims, 9 Drawing Sheets

U.S. PATENT DOCUMENTS

| | | | | |
|---|---|---|---|---|
| 5,546,088 | A | 8/1996 | Trummer et al. | |
| 5,842,587 | A * | 12/1998 | Wanek et al. | 212/177 |
| 6,186,347 | B1 | 2/2001 | Reifenscheid et al. | |
| 7,219,810 | B2 * | 5/2007 | Willim | 212/300 |

FOREIGN PATENT DOCUMENTS

| | | | |
|---|---|---|---|
| EP | 0733584 | A1 | 9/1996 |
| EP | 0794149 | A2 | 9/1997 |
| EP | 0970914 | A2 | 1/2000 |
| JP | 60148893 | A2 | 8/1985 |
| JP | 07061773 | A2 | 3/1995 |
| JP | 11322278 | A2 | 11/1999 |
| JP | 2002046981 | A2 | 2/2002 |

OTHER PUBLICATIONS

"International Search Report for Application No. PCT/EP2004/003223, date mailed Aug. 6, 2004", 5 Pages.

"Written Opinion of the International Searching Authority, for PCT application No. PCT/EP2004/003223, mailed Aug. 6, 2004", 7 pgs.

Becker, Rudolf , "Das grosse Buch der Fahrzeugkrane: Handbuch der Fahrzeugkrantechnik", *Rene Hellmich KM-Verlags GmbH*, (2001),87-90, 177-183 (English translation provided).

* cited by examiner

METHOD FOR ERECTING AN AT LEAST TWO-PIECE MAIN BOOM FOR A LATTICE-BOOM CRANE AND LATTICE-BOOM CRANE BUILT ACCORDINGLY

TECHNICAL FIELD

This application is a continuation under 35 U.S.C. 111(a) of PCT/EP2004/003223, filed Mar. 26, 2004 and published as WO 2004/087557 A1, filed Oct. 14, 2004, which claimed priority under 35 U.S.C. 119 to U.S. Provisional Patent Application No. 60/459,669, filed Apr. 2, 2003, which applications and publication are incorporated herein by reference and made a part hereof.

The present invention relates to a method for erecting a boom of a crane, and in particular a method for erecting a main boom of a lattice-boom crane subdivided into at least two jib portions. The main boom is not erected necessarily with the aid of an auxiliary crane or other additional means, but rather results from using the geometric-kinematic properties of the main boom subdivided into at least two jib portions. Moreover, the present invention relates to a main boom for a lattice-boom crane being adapted for being erected using the method according to the invention such that auxiliary means for erection, as e.g. auxiliary cranes, are not compulsory. Moreover, the invention relates to a crane, in particular a lattice-boom crane having a main boom, being constructed to be erected using the method according to the invention.

BACKGROUND OF THE INVENTION

Usually, booms of lattice-boom cranes comprising a luffing tip or a fly jib are erected with the aid of a so-called superlift device with a counter boom and an additional counter weight or with the aid of an auxiliary crane, as it is e.g. already explained in the DE 30 42 287 A1 as being disadvantageous. To overcome this disadvantage, a boom for a telescopic crane is proposed there, the luffing tip jib of which has two tension supports being pivoted thereto, whereby the telescopic boom including the luffing tip can be mounted to a large extent lying on the ground and can be brought to the operating position subsequently without further auxiliary means. This is carried out in that during erecting the telescopic boom, the entire restraint is tightened, whereby the tension supports are erected. As soon as the restraint is tightened, the luffing tip jib is positioned in its final inclination with respect to the telescopic boom which is determined by the respective length of the guy wires. By further lifting the telescopic boom, the entire boom eventually is brought into its operating position.

Such a procedure, according to which the entire boom together with a luffing tip being arranged at the jib is erected in its operating position already, can usually only be realized, however, for very light and short luffing tip jibs. Usually, these luffing tips are extensions of the main boom of a crane, wherein the inclination of these luffing tips is adjustable during operation of the crane. In case one would try to erect the mostly very long booms of lattice-boom cranes, which if necessary can also be built in two pieces, i.e. comprising a main boom and a fly jib or luffing tip being jointed to the main boom, already in their operating position without any auxiliary means, normally this would not function due to the tilting moment producible by the weight of the boom in connection with the very long lever arm of the entire boom. This would normally fail because the tilting moment producible by the weight of the boom in connection with the very long lever arm of the boom usually is larger than the retaining standing moment of the mobile crane, which is determined by the geometric properties of the under carriage as well as the upper carriage and the weight distribution including additional counter weights.

To overcome said deficiency, the Japanese patent applications JP 11-322278 and JP 2002-46981 propose to provide the jibs of very weak lattice-boom cranes with an additional luffing fly jib or with a luffing tip, which during erection of the lattice-boom or telescopic jib bends relative to the boom. A similar lattice-boom crane is disclosed in U.S. Pat. No. 3,794,184. As it will become apparent from said document, the cranes disclosed therein exclusively relate to cranes comprising a main boom to which a separate fly jib is jointed, wherein the inclination of said fly jib is adjustable during operation as well. A similar crane is for example disclosed in the book "Das groβe Buch der Fahrzeugkrane" by Rudolf Becker on pages 88cf. as well as on pages 178cf. As will become apparent therefrom, the jib of said crane consists of two individual jibs, namely of a separate main boom and a separate fly jib which is luffably (arranged in a luffable manner) arranged to the main boom, both of which are adapted to luff with respect to each other during operation. Moreover, EP 0 733 584 discloses a tower crane comprising a needle jib, which is adapted to be folded up.

Indeed, by means of the two-piece construction of the jib known from JP 11-322278 and JP 2002-46981, the length and the height respectively as well as the reach which may be achieved by said jib may be increased. However, said supposed positive effect of such a jib consisting of a main boom and a separate fly jib, which is, even during operation, luffably arranged at the main boom, has an adverse effect on the working load of the jib, which rapidly decreases as a result of the articulated joint of the fly jib. Hence, these cranes are not suitable to achieve high working loads, wherefore there is usually no other choice but to use a lattice-boom crane having a rigid and unbending main boom, which normally only can be erected with the aid of an additional auxiliary crane, as will be illustrated below.

Hence, the skilled person is still often confronted with the problem, either to use relatively weak cranes having for example a two-piece jib comprising for example a separate telescopic jib and a separate fly jib, which is even during operation luffably arranged at the main boom, to serve major height by the crane. Because of the decreased working load caused by the two-piece construction of the jib, however, by means of these cranes it is not possible to carry major loads. Alternatively it was only possible to use heavier lattice-boom cranes, wherein the main boom of said cranes had to be erected with the aid of an auxiliary crane.

At this point the present invention intervenes, according to which the main boom of such a lattice-boom crane is no longer built up as a one-piece rigid jib, but according to which the main boom during assembly comprises two separate and individual lattice-boom portions being hinged to each other, which are adapted to become bended to each other during assembly and which are further adapted to become rigidly attached to each other during the operation of the crane or in the final state. Hence, by means of the present invention, the respective advantages of the aforementioned cranes can by combined with those advantages of a lattice-boom crane.

As can be deducted from the explanations above, within the scope of the present invention, by tilting moment, the moment is meant, which is generated by the boom as soon as the latter is supported only on one point, namely the point of the articulated joint at the upper carriage of a crane. As long as the boom has a second point of support besides this first point of support, no tilting moment is produced by this boom. On the other hand, however, by standing moment, the moment counter acting the tilting moment is meant. The standing moment is determined by the geometric properties as well as by the weight distribution of the under carriage, the upper carriage as well as possibly by the auxiliary and counter weights attached thereto.

The longer a boom is the larger is the tilting moment which can be generated thereby. To erect a very long boom at one time, it would be necessary to provide a large standing moment accordingly such that the tilting moment does not exceed the standing moment during the erecting process. In case the tilting moment should still be larger than the standing moment, the crane would at least tend to tilt. In the most disadvantageous case the crane would in fact tip over. To antagonize this risc, the under carriage and the upper carriage including all possible additional weights would have to be constructed such that the standing moment always is at least equal to the tilting moment producible. For very long booms, this however would lead to extraordinary heavy and large dimensions of the parts defining the standing moment, as for example the under carriage, the upper carriage as well as the weights attached thereto.

To take account of this, usually auxiliary cranes are used as illustrated above during the erection of long main booms or lattice-boom cranes, by means of which the main boom is brought into position. This, e.g., results in that the hook of the auxiliary crane is attached approximately in the center of the main boom. Subsequently, the main boom jointed to the upper carriage is erected with the auxiliary crane up to such an angle position, in which the tilting moment is smaller than the standing moment of the crane. As soon as this position is reached, a retaining cable of the crane is activated, keeping the main boom in this inclined position, such that the hook of the auxiliary crane can be disengaged.

In this position, the main boom is already in a crane operating position, in which the main boom can be swung only slightly around the hinge point on the upper carriage. In this crane operating position, in which the main boom mostly has a very steep inclination with respect to the horizontal plane, the tilting moment is essentially smaller than in the starting position, in which the entire main boom lies on the ground. This results from the fact that the respective tilting moment results from the boom weight and the projection of the boom length into the horizontal plane, which usually is also termed as effective lever arm. Thus, in the crane operating position, the main boom is inclineable to such a degree, according to which the effective lever arm is attached so far that the tilting moment does not exceed the standing moment.

Another known possibility to erect a long main boom is that special auxiliary means for erecting the main boom are used which mostly are attached to the crane as external means. Amongst these, e.g., is the so called super lift device, consisting of a restraint with a counter boom and an auxiliary counter weight which is arranged on the super lift device. The use of such a super lift device, however, requires an increased transport and time expenditure for the assembling and disassembling of the counter boom as well as the additional counter weights.

Starting from these known methods for erecting or disassembling a main boom, respectively, therefore, the present invention has the object to provide a method for erecting and disassembling a main boom for a lattice-boom crane, enabling to erect the main boom without an auxiliary crane or other auxiliary means, such that the time expenditure for the assembling and disassembling of the main boom is reduced and additional costs arising from the use of an auxiliary crane can be avoided. Further, according to the present invention, a main boom for a lattice-boom crane should be provided, which is erectable more easily and faster than known main booms and which combines the advantages of a common lattice-boom with the advantages of a telescopic crane assembled with an articulated and luffing fly jib.

DESCRIPTION OF THE INVENTION

In view of the problems involved in the known methods for erecting a main boom for a lattice-boom crane, a method for erecting a main boom for a lattice-boom crane is provided according to a first aspect of the present invention, according to which the main boom can be erected without any external auxiliary means, as for example an auxiliary crane. The method is characterized in that in a first step, the main boom is aligned to its starting position, in which the main boom, which consists of a lower boom portion and an upper boom portion being jointed thereto during assembly, is supported with its lower end at a first support point on the upper carriage of the crane jointly. Further, the main boom is supported in the starting position at least on a second support point on the ground. This at least second support point can be a point of contact of the lower as well as of the upper boom portion to the ground. Naturally, also the lower as well as the upper boom portion simultaneously can form a contact point to the ground in the starting position.

As soon as this starting position is established, according to which the main boom attached to the upper carriage of the crane is supported on at least a second point on the floor, it can be started in a further step, to shorten the effective lever arm of the main boom. This is carried out in that an angle position between the lower and the upper boom portions is generated, maintaining the second support point. This e.g., can result in that the lower boom portion, which for example extends between the upper end of the lower boom portions and the upper carriage, is raised with a retaining cable. Because the upper boom portion is pivoted to the lower boom portion, due to the erecting movement of the lower boom portion, the lower end of the upper boom portion is raised upwards, whereby the boom tip is caused to move into the direction of the hinge point on the upper carriage of the crane. In other words, the lower boom portion is raised, whereby the upper boom portion is bent at the hinge point of both boom portions, whereby the entire main boom is folded practically.

Another possibility for shortening the effective lever arm consists e.g. therein, to first keep the lower boom portion on the ground, maintaining the second support point, and to first erect the upper boom portion. By this erection procedure, according to which the upper boom portion rotates around the hinge of the lower boom portion, the effective lever arm of the main boom in turn is shortened. This step, according to which the effective lever arm of the main boom is shortened, either by lifting the lower or the upper boom portion, lasts as long as the tilting moment producible by the boom weight is smaller than the standing moment of the crane.

As soon as the tilting moment, reduced by shortening the effective lever arm, is smaller than the standing moment of the crane, it can be started to lift the boom portions mutually angled by pivoting around the hinge at the upper carriage of the crane in this further process step. To keep the angle position between the lower and the upper boom portions during this at least substantially constant, the upper and the lower boom portions are coupled during assembly by a coupling element to each other kinematically.

Subsequently, the lower and the upper boom portions are aligned into a crane operating position. Thereby, the crane operating position is the position of the main boom, according to which the main boom is aligned using the above described known methods, and in which the crane is ready to be operated without additional aid.

If it is explained within the scope of the present invention that the angle position "is kept substantially constant" or "is kept substantially straight", this can mean on one hand that the angle position between the lower and the upper boom portion during the lifting of the boom portions in fact are exactly kept constant. By "substantially constant" or "substantially straight", however, within the scope of the present invention also a successive adaptation of the angle position between the lower and the upper boom portions during the lifting to the respective position of the lower boom portion can be meant, to guarantee that the upper boom portion always has an optimal position with respect to the lower boom portion during lifting. This for example could mean that the angle of the upper boom portion to the horizontal plane during lifting of the lower boom portion can be kept approximately constant.

As soon as the crane operating position is reached, the lower boom portion can be connected to the upper boom portion rigidly. However, it is also possible to maintain the crane operating position by the coupling element between the lower and the upper boom portions whereby it can be guaranteed that during the operation of the crane, the upper boom portion can be swung by activating the coupling element with respect to the lower boom portion.

The advantage of the method according to the present invention lies therein that during erecting a main boom for a lattice-boom crane using the method according to the invention, no auxiliary means, as for example an auxiliary crane, are required. This, on one hand, results therein that the entire erection procedure can be carried out faster. On one hand, the costs e.g. for an auxiliary crane for erecting can be avoided, on the other hand, the whole duration for using the crane is reduced, which also includes the mostly very time intensive assembling and disassembling. Thus, the entire crane employment becomes more cost efficient.

According to a particular aspect of the present invention it is provided for producing the angle position between the lower and the upper boom portions in that at first the lower boom portion is erected. According to this erection procedure of the lower boom portion, the upper end of the lower boom portion is moved upwards which at the same time is the hinge between the lower and the upper boom portion on a circular path, the center of which is the hinge point on the upper carriage. By this movement, the projection of the hinge point between the lower and the upper boom portions into the horizontal plane, is moved towards the hinge point on the upper carriage. During this erection procedure of the lower boom portion, the coupling element between the lower and the upper boom portions is not locked, such that during this movement, the boom tip, forming the second support point of the main boom with the ground, is caused to move in the direction of the hinge point on the upper carriage of the crane, maintaining this at least second support point. Thus, during the erection procedure of the lower boom portion, on one hand the projection of the hinge point between the lower and the upper boom portions into the horizontal plane is moved, and on the other hand, the boom tip is moved towards the hinge point on the upper carriage of the crane, whereby the overall effective lever arm of the main boom is reduced.

This procedure, according to which at first the lower boom portion is erected, is particularly advantageous due to the fact that a very simple and safe process is guaranteed. A very great advantage lies therein that, if at first the lower boom portion is erected, only slight constructural changes have to be carried out on the already known main booms, such that also these can be erected or disassembled, respectively, by means of the process according to the invention.

According to an advantageous embodiment, the lower boom portion is erected with the aid of a lower retaining cable, extending between the upper carriage and the lower boom portions. By applying a traction force for example by means of a winch or a hoist onto this lower retaining cable, the lower boom portion is caused to carry out a luffing movement, whereby the lower boom portion is aligned.

This, in particular is advantageous due to the fact that also standardized means, as for example the lower retaining cable, which is tightened over the tension support by means of the hoist towards the upper carriage, can be used for the erection procedure according to the invention.

According to a further aspect of the method according to the invention, a coupling element, coupling the lower and the upper boom portion to each other kinematically, is a traction or a pressure element. The particular advantage using a traction or pressure element is that it can be guaranteed hereby that during the lifting of the angled boom portions, the angle position between the lower and the upper boom portions can be maintained substantially. Thereby, in particular a successive adaptation of the angle of the upper boom portion into the horizontal plane during erecting the lower boom portion e.g. is possible.

According to a particular embodiment of the method according to the invention, the two boom portions are kept in the angled position with a hoist. As during the step in which the effective lever arm of the main boom is shortened by producing an angle position between the lower and the upper boom portions, the hoist has not to be locked, the hoist has to be locked or activated during the lifting of the angled boom portions, to substantially maintain the angle position of the angled boom portions during lifting.

According to a very preferred embodiment of the method according to the invention, the traction element generates a force between a lower support, arranged at the lower boom portion and an upper support at the upper boom portion, which in turn are stretched towards the boom base or to the boom tip, respectively. The two supports are lying within the luffing plane of the main boom such that a construction, consisting of the lower and the upper boom portions, the two supports, being stretched towards the boom tip and the boom base, respectively, and the traction element between the two supports, can be termed as stretched support according to the commonly used terminology of structural analysis. To guarantee the force transmission between the lower and the upper boom portions by means of a traction element extending between two supports arranged accordingly, this has proven to be especially advantageous due to the fact that by means of such an arrangement for maintaining the angle position between the lower and the upper boom portions, very little force is required, whereby smaller drive assemblies are employable for operating a traction element, and also the traction element itself can be of smaller dimensions.

According to a further advantageous embodiment of the method according to the invention, the force transmission for maintaining the angle position between the lower and upper boom portions results by means of a traction element, which is effective between a support arranged at a lower boom portion, which is wired by a retaining cable to the upper carriage and the boom tip. This embodiment of the method according to the invention is particularly advantageous due to the fact that during erection of the lower boom portion for shortening the effective lever arm of the main boom by producing an angle position between the lower and the upper boom portions, the same lower retaining cable can be used which also is used in the crane operating position for holding the main boom in the aligned boom position. Further, additional stretching means in form of a restraint for the main boom can be omitted.

As was revealed by the previous embodiment, during the erection procedure of the main boom, the boom tip moves at first towards the support point on the upper carriage of the crane, maintaining the at least second support point. To not damage the boom tip during this movement due to friction between the ground and the boom tip, according to a particular aspect of the present invention it is provided for supporting the movement of the boom tip by means of a roller or a sliding element which is arranged on the boom tip. Hereby, on one hand the boom tip will be less damaged, on the other hand, the friction between the boom tip and the ground is reduced such that for shortening the effective lever arm of the main boom, less force is required.

If the boom tip has approached the hinge point of the lower boom portion on the upper carriage of the crane so far that the tilting moment producible by the main boom is smaller than the standing moment of the crane, the traction element is locked or activated. Hereby, during the further erection procedure, the angle position between the lower and the upper boom portions is kept substantially constant, whereby the ground contact of the boom tip is lost. If, at the latest after reaching a rise position of the lower boom portion, the upper boom portion is brought into the stretched boom position by activating the traction element, the lower boom portion can be connected to the upper boom portion rigidly, so that the main boom is completed as a unitary entirety. For this rigid connection, a bolting of the two boom portions has proved to be particularly suitable, whereby, however, also any other process can be suitable, to provide a rigid connection between the two portions. Thus, it is e.g. also possible, instead of bolting the two boom portions to each other, to lock the traction element completely, whereby also twisting of the two portions is avoided.

According to a further aspect of the method according to the invention, an initial tension is applied to the main boom after the two boom portions are connected to each other rigidly, by further activating the traction element. Such an initial tension is advantageous due to the fact that thereby a further working load increase of the main boom is possible.

According to a further embodiment of the method according to the invention, the angle position between the lower and the upper boom portions is produced by a piston cylinder unit, coupling the two boom portions to each other kinematically. The angle position between the lower and the upper boom portions is produced by using a pressure element, in that the upper boom portion is erected by the pressure element, whereby the boom tip is caused to move on a circular path, the center of which is the hinge between the lower and the upper boom portions, towards the hinge point on the upper carriage of the crane. This embodiment, using the pressure element, is very advantageous due to the fact that an especially simple rope or retaining cable guide is enabled thereby.

According to this embodiment of the method according to the invention, it is possible to only provide one retaining rope for erecting or holding the main boom in the crane operating position. Further, an additional restraint of the main boom can be omitted. Naturally, it is possible, however, to apply an initial tension of the already described type, to effect a working load increase of the main boom.

As soon as the projection of the boom tip into the horizontal plane has approached the hinge point on the upper carriage of the mobile crane so far that the tilting moment producible by the boom weight is smaller than the standing moment of the crane, it will be started to erect the lower boom portion. Hereby, the at least second support point is lost which up to this point was present between the lower boom portion and the ground. The alignment of the lower boom portion results from a lower retaining cable which tensions the lower boom portion towards the upper carriage of the crane. A tensioning of the lower boom portion towards a tension support attached to an upper carriage of the crane which in turn is tensioned via a hoist to a counter weight arranged at an upper carriage has found to be advantageous.

According to a special aspect of the method according to the invention, during the erection of the lower boom portion, the upper boom portion is maintained under a substantially continuous angle to the horizontal plane or is lowered with respect to the lower boom portion, respectively. This procedure has found to be advantageous because hereby the danger of tilting of the upper boom portion beyond the vertical reference line is encountered.

At the latest after reaching a rise position of the lower and the upper boom portions, the two boom portions are rigidly connected to each other, the entire main boom can be kept in the stretched boom position by an upper retaining cable, stretching the upper boom portion towards the upper carriage of the crane. This upper boom portion e.g. can in turn by the tensioned over the same tension support as the lower retaining cable and the hoist towards the upper carriage or directly towards the upper carriage.

As revealed by the explanations above, the method according to the invention is especially advantageous due to the fact that by using the method, very long main booms and in particular very long main booms for lattice-boom cranes can be erected by themselves in a manner without any auxiliary means, as for example auxiliary cranes or additional super lift devices or the like being required. By using the method according to the invention, the crane succeeds virtually by itself to bring its main boom into a crane operating position. Because thus, no further auxiliary means as auxiliary cranes or the like are required, the time expenditure for the assembling and disassembling of the crane boom can be reduced substantially. Moreover, naturally no further costs for possible auxiliary means as auxiliary cranes or the like are generated.

Studying the above explanations of the present invention, the person skilled in the art realizes that based on the basic idea of the method for erecting a boom for a lattice-boom crane, namely the shortening of the effective lever arm during the erection procedure, a main boom can be constructed in an analogous manner.

This means that at first the rigid connection between the lower and the upper boom portions is released. Subsequently, an angle position can be generated between the lower and the upper boom portions from the crane operating position. This results for example in that the upper boom portion is lowered by lengthening the hoist or in that in a further embodiment, the upper boom portion is angled with respect to the lower one by activating a piston cylinder unit which couples the lower and the upper boom portions to each other.

The angle position thereby has to be selected such that during the whole disassembling procedure, as long as the main boom is not yet supported on at least a second support point, the tilting moment producible by the boom weight maximally corresponds to the standing moment of the crane. This condition has to be met for the fact that during the next process steps in which the angled boom portions are lowered, the effective lever arm is increased, whereby the producible tilting moment increases. Naturally, the tilting condition (tilting moment smaller than standing moment!) during lowering the angled boom portions also can be met thereby that during the lowering, the angled boom portions of the upper boom portion always are controlled such that the effective lever arm of the main boom does not become inadmissibly large.

After during lowering of the angled boom portions, the main boom is lying on at least a second point on the ground, the main boom can be brought into its stretched position in a final process step, maintaining the at least second support point, in which it is lying loosely on the ground and in which the main boom can be disassembled for transport.

Further, according to the present invention, an at least two-piece main boom for a lattice-boom crane is provided, being adapted for being erected without any auxiliary means as for example auxiliary cranes or the above described super lift device. The main boom comprises a lower boom portion, being hingeable to the upper carriage of the crane and being connected during assembly via an articulated connection to the upper boom portion. Between these two boom portions, a coupling element is arranged, coupling the lower and the upper boom portions to each other kinematically during assembly. According to the invention, the coupling element has to be operated during the alignment process such that for shortening the effective lever arm of the main boom, a substantially constant angle position is guaranteed between the lower and the upper boom portions.

Normally, the lower as well as the upper boom portions are built in lattice construction. However, naturally it is possible, to construct the lower boom portion as a telescopic boom.

In case the coupling element is formed as a traction element and in a very exemplary embodiment as a hoist, extending between a lower support arranged at a lower boom portion and an upper support at the upper boom portion, which in turn is stretched towards the boom base and the boom tip, respectively, the hoist is to be operated such that during the alignment process a certain angle position between the lower and the upper boom portions is kept substantially constant. This can mean, on one hand, that the hoist is fixedly locked, such that a certain angle position is maintained exactly or that the hoist is controlled such that an optimum angle position of the upper boom portion is guaranteed at the respective point of time of the alignment process. Such locking or activating of the traction element results at the earliest at the time when the tilting moment producible by the boom weight is smaller than the standing moment of the crane.

In another preferred embodiment of the main boom, the traction element is arranged between a support arranged at a lower boom portion, being stretched towards the upper carriage and the boom tip. This embodiment is found to be advantageous due to the reason that additional supports which in turn are stretched towards the boom tip, can be omitted.

According to a further embodiment of the main boom, the coupling element is formed as a pressure element and according to a particular embodiment as piston cylinder unit. To angle the two boom portions with respect to each other, the piston cylinder unit is arranged at the lower side of the main boom such that during its activating, the upper boom portion can be angled upwards.

Moreover, the present invention refers to a lattice-boom crane with a boom, being constructed such that it can be erected using the process according to the invention for erecting a main boom for a lattice-boom crane, as previously described in detail.

BRIEF DESCRIPTION OF THE DRAWINGS

In the following several embodiments of the present invention are described in detail referring to the attached drawings for a better understanding and for further explanation.

Same components are indicated with same reference numerals in all figures.

DESCRIPTION OF EXEMPLARY EMBODIMENTS OF THE INVENTION

Figure 1:
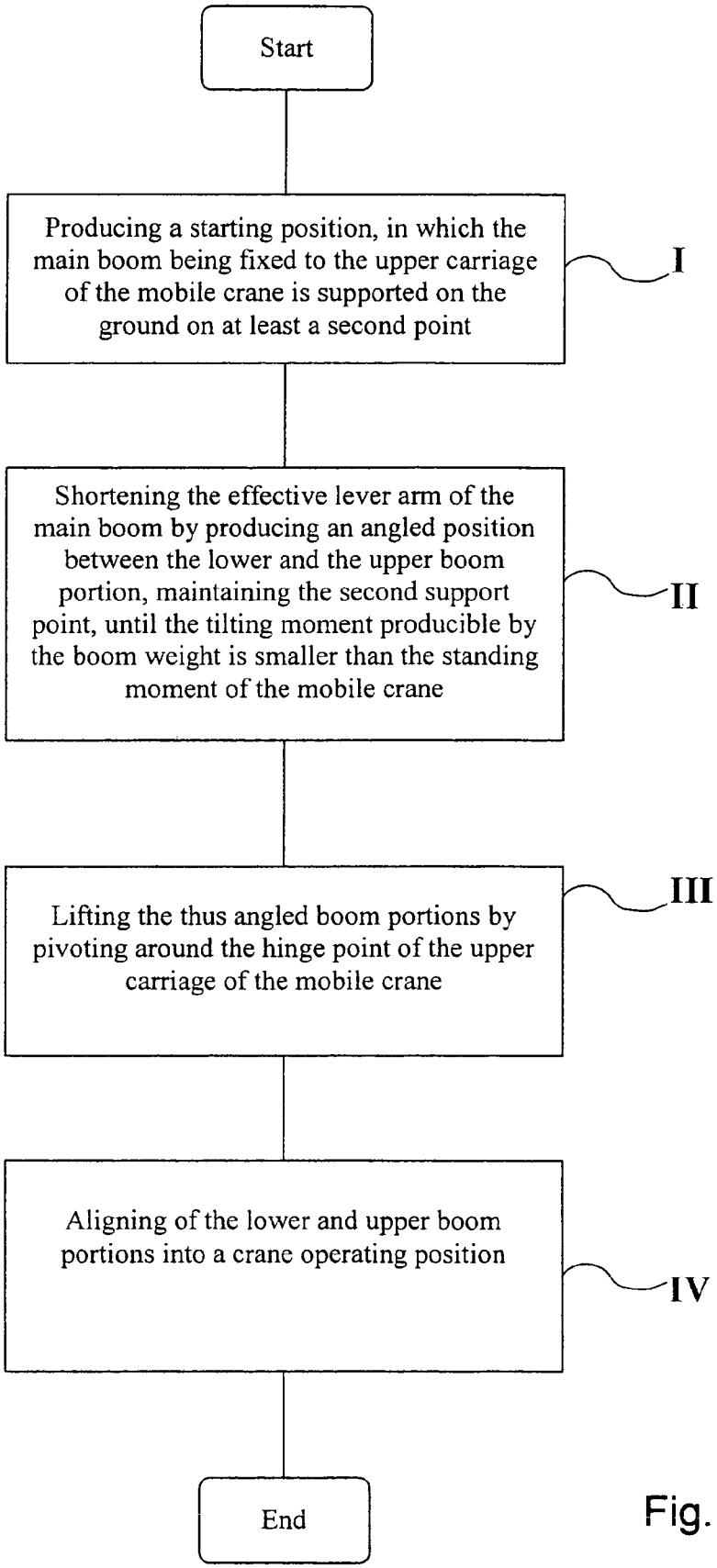
FIG. 1 is a flowchart of the method according to the invention for erecting a main boom for a lattice-boom crane.

FIG. 1 shows the single process steps according to the invention in a flow chart, required for erecting a main boom 1, 2, consisting of a lower boom portion 2, lying against the upper carriage 14 of the crane carriage 19, and an upper boom portion 1, being connected via an articulated connection A during assembly to the lower boom portion 2. As illustrated here, the lower as well as the upper boom portions 1, 2 are built in lattice construction.

In a first step I, a starting position is generated, in which the main boom 1, 2 attached to the upper carriage 14 of the mobile crane is supported on a second point D on the ground. As for example can be seen from FIG. 2*a*, a starting position is the position, in which the main boom 1, 2 is lying loosely on the ground and is attached to the hinge point C of the upper carriage 14. As soon as the main boom 1, 2 is in this starting position, in a subsequent process step it can be started to shorten the effective lever arm 1' of the main boom 1, 2 (step II). This results in that during assembly an angle position between the lower 2 and the upper boom portion 1 is generated, maintaining the second support point D.

Figure 2A:
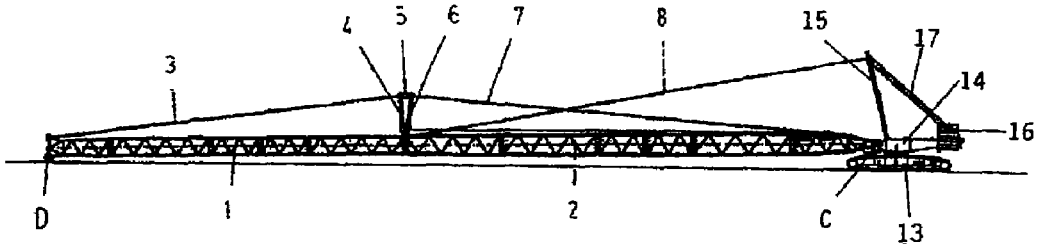
FIG. 2*a* is a view of a mobile lattice-boom crane with a main boom in a starting position, which can be erected using the method according to the invention.
Figure 2B:
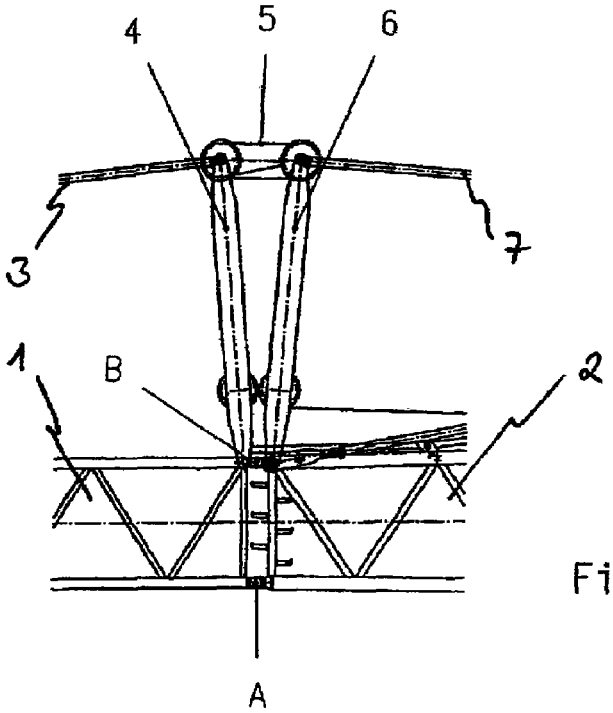
FIG. 2*b* is a detail of the main boom of FIG. 2*a* in a transitional zone between the lower and the upper boom portion.
Figure 2C:
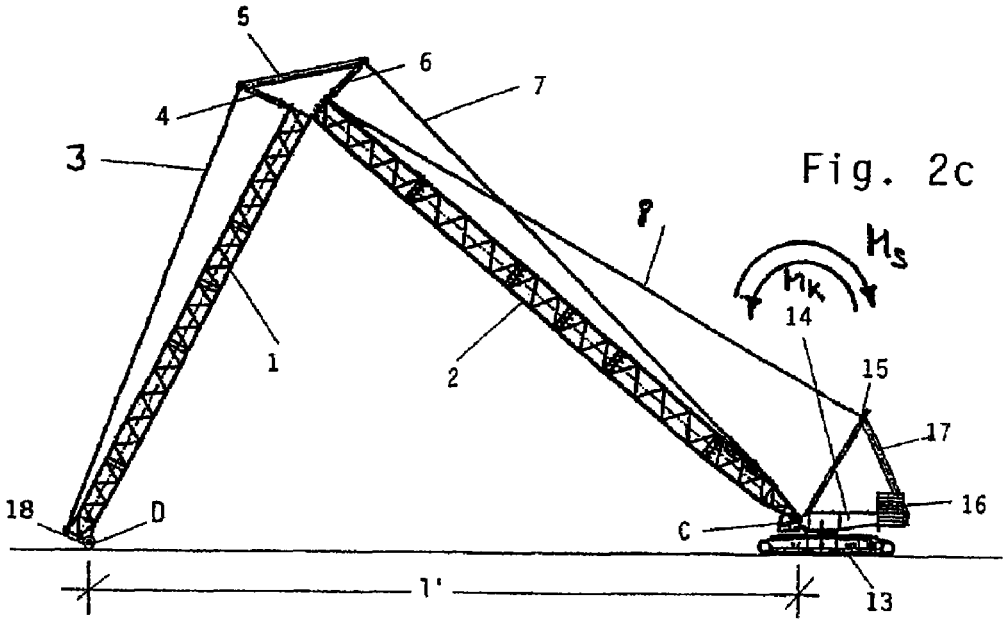
FIG. 2*c* shows the main boom of FIG. 2*a* in an angled position with a second support point.

As is revealed from FIG. 2*c*, this shortening of the effective lever arm I' results from the lower boom portion 2 being raised, whereby the boom tip of the upper boom portion 1 is caused to move towards the hinge point C of the upper carriage 14. This shortening of the effective lever arm 1' results as long as $M_K$ producible by the boom weight 1, 2 is smaller than the standing moment $M_S$ of the crane carriage 19.

Figure 2D:
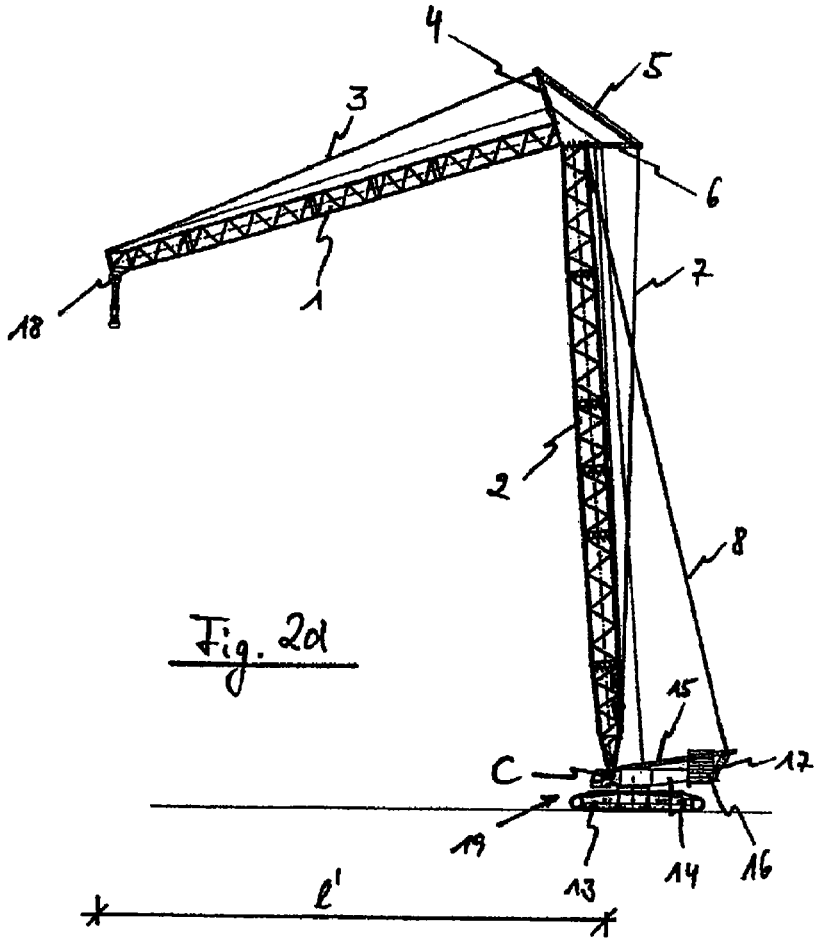
FIG. 2*d* shows the main boom of FIG. 2*a* in an angled position without a second support point.

When the tilting moment $M_K$ and the standing moment $M_S$ are in equilibrium, in a fhrther step III it is started to lift the angled boom portions 1, 2 by pivoting them around the hinge C at the upper carriage 14 of the crane carriage 19 (FIG. 2*d*). Already during the lifting of the angled boom portions 1, 2, the upper boom portion 1 in turn can be pivoted simultaneously upwards around the hinge A, at which it is coupled to the lower boom portion 2.

Figure 2E:
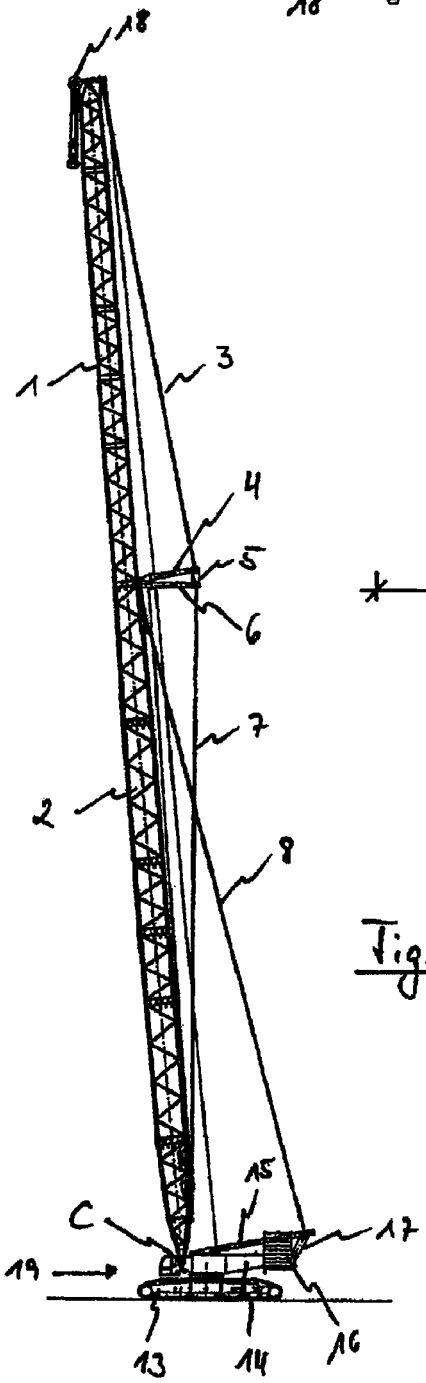
FIG. 2*e* shows the main boom of FIG. 2*a* in a crane operating position.

In a final process step IV, the lower 2 and upper boom portion 1 are aligned into a crane operating position (FIG. 2*e*).

In the following different possibilities are shown with reference to FIG. 2*a* to 3*f*, to erect a main boom 1, 2 using the method according to the invention. As already described, FIG. 2*a* shows a starting position of the method according to the invention, in which the main boom 1, 2 is lying flat on the ground and is hinged to the upper carriage 14 of the crane carriage 19. The upper boom portion 2 is stretched over a retaining cable 8 to a counter weight 16 via the tension support 15 and a hoist 17. As becomes apparent most clearly from FIG. 2*b*, in a transitional zone of the two boom portions 1, 2, two supports 4, 6 are arranged, extending approximately perpendicular to longitudinal axis of the two boom portions 1, 2. The tips of the two supports are connected to each other via a hoist 5. The support 4 is connected over an upper restraint 3 to the boom tip, the support 6 on the other hand is connected to the boom base by a lower restraint 7. By applying a traction force to the retaining cable 8 via the hoist 17, the lower boom portion starts to rise, as it is illustrated in FIG. 2*c*. Thereby, the hoist 5 is released and lengthened. Due to the kinematical relation during assembly of the two boom portions, the boom tip of the upper boom portion 2 is caused to move over the ground towards hinge point C. To facilitate this movement of the boom tip and to not damage the boom tip during this movement, a roller 18 is arranged on the boom tip. Instead of the roller 18, naturally also a friction plate or a sliding element, for example made from teflon, can be arranged for supporting the movements of the boom tip.

Assuming that in the position, the main boom is in according to FIG. 2*c*, the tilting moment $M_K$ producible by the main boom is equal to the standing moment $M_S$ of the crane carriage 19, in this position the hoist 5 being still loose up to this point, can be locked at the earliest. If now it is proceeded to shorten the hoist 17, in the following movement, the upper boom portion 1 is lifted (FIG. 2*d*). After reaching the rise position of the lower boom portion 2, shown in FIG. 2*d*, the upper boom portion 1 is brought into the stretched crane operating position according to FIG. 2*e*, by activating the hoist 5. In this position the two boom portions 1, 2 can be bolted together at a bolting point B (see FIG. 2*b*) to a unitary rigid main boom such that the crane is ready to be operated.

Figure 3A:
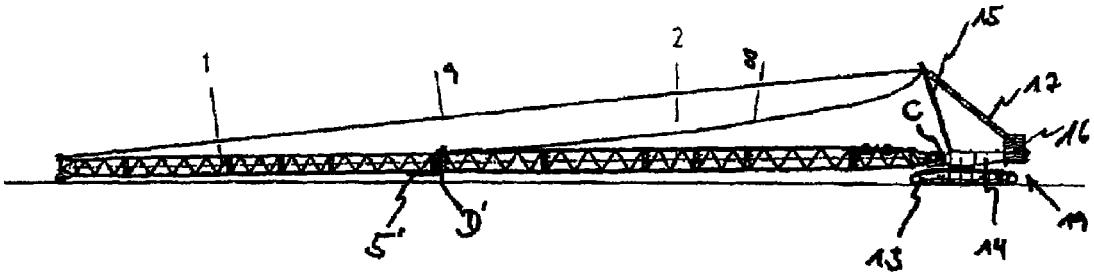
FIG. 3*a* is a view of a further embodiment of a mobile lattice-boom crane with a main boom in a starting position, which can be erected using the method according to the invention.

Another possibility to erect a main boom using the method according to the invention is shown in FIG. 3*a* to 3*f*. In FIG. 3*a* again a starting position of the main boom 1, 2 is illustrated, in which the latter is supported besides the first support point in form of a hinge to hinge point C on the upper carriage 14 at least on a second support point D' on the ground. The upper boom portion 1 and the lower boom portion 2 are respectively stretched via the upper retaining cable 9 and a lower retaining cable 8, respectively, via the tension support 15 by means of a hoist 17 towards a counter weight 16 at the upper carriage 14. In the position shown in FIG. 3*a*, the two retaining cables 8, 9 are released.

Figure 3B:
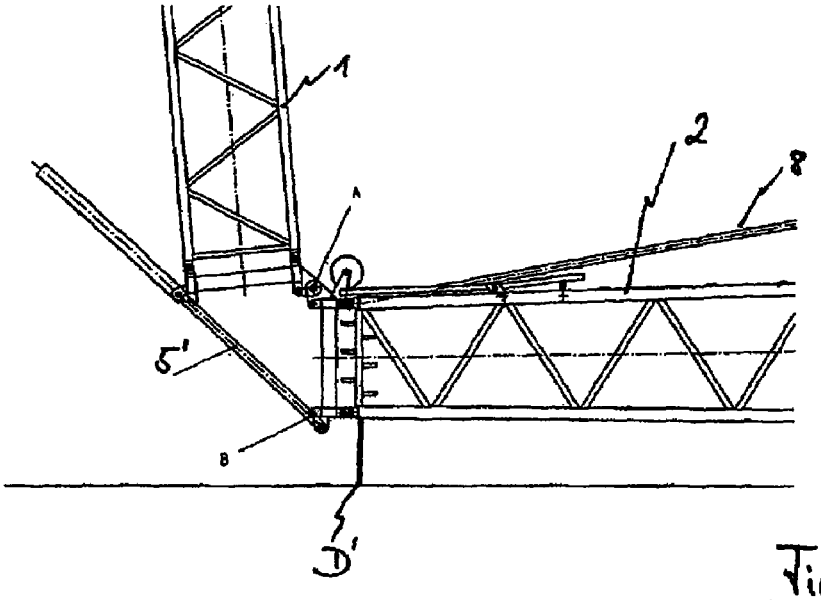
FIG. 3*b* is a detail of the boom of FIG. 3*a* in a transitional zone between the lower and the upper main boom portion.
Figure 3C:
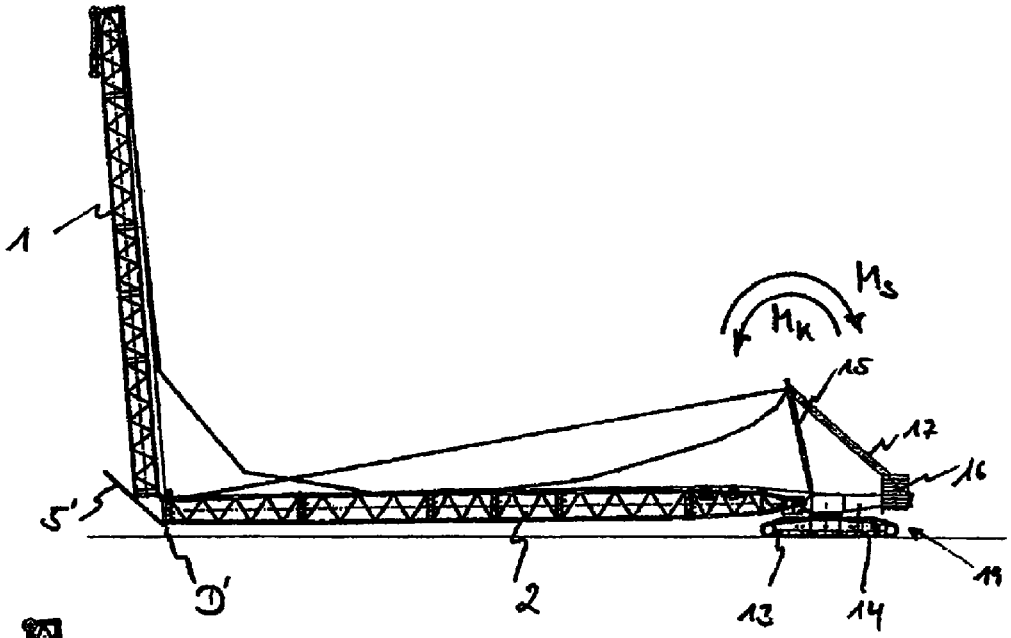
FIG. 3*c* shows the main boom of FIG. 3*a* in an angled position with a second support point.

Starting from this starting position, according to FIGS. 3*b* and 3*c*, the lower boom portion 1 is lifted by operating the piston cylinder unit 5', whereby the boom tip of the upper boom portion 1 is caused to move on a circular path with center point A into the position shown in FIG. 3*c*. In this position, the effective lever arm 1' is reduced clearly whereby the tilting moment $M_K$ producible by the main boom 1, 2 has become substantially smaller. Assuming again that the position shown in FIG. 3*c* is the position in that the tilting moment $M_K$ is in equilibrium with the standing moment $M_S$, then at the earliest in this position it can be started to activate the hoist 17 whereby by means of traction on the retaining cable 8, the lower boom portion 2 is erected. Thereby, the ground contact at the second support point D is lost.

Figure 3D:
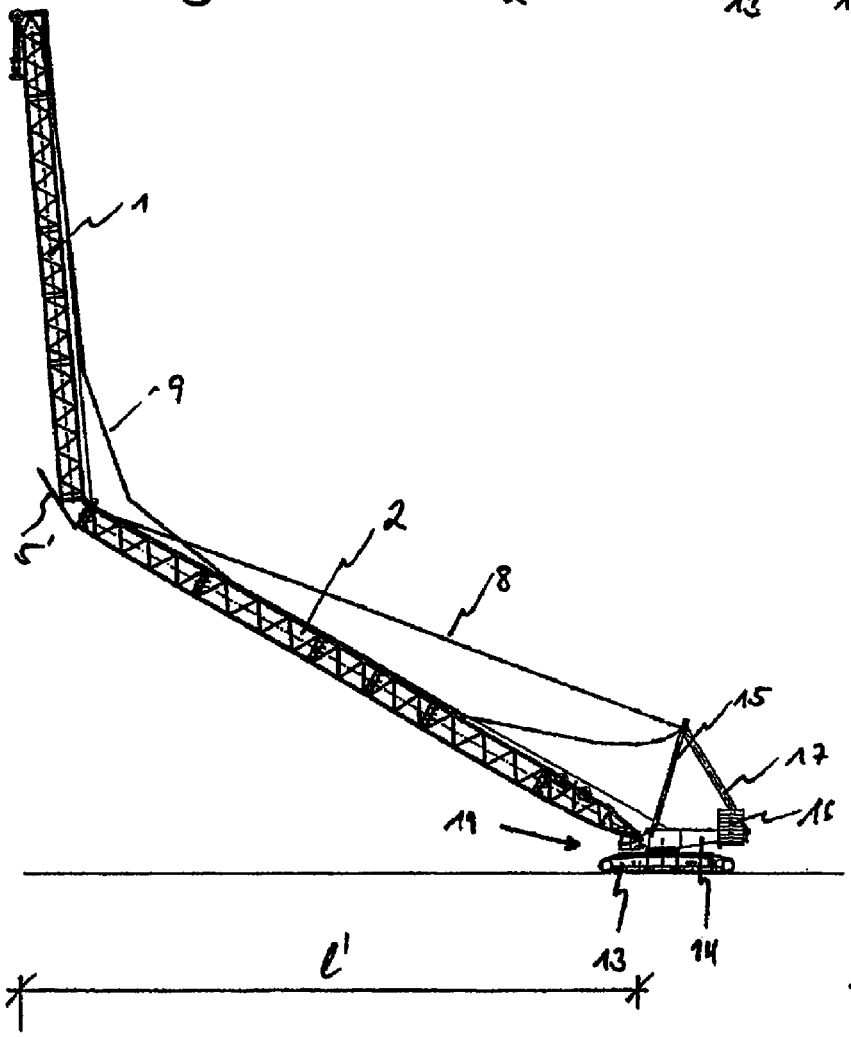
FIG. 3*d* shows the main boom of FIG. 3*a* in an angled position without a second support point.
Figure 3E:
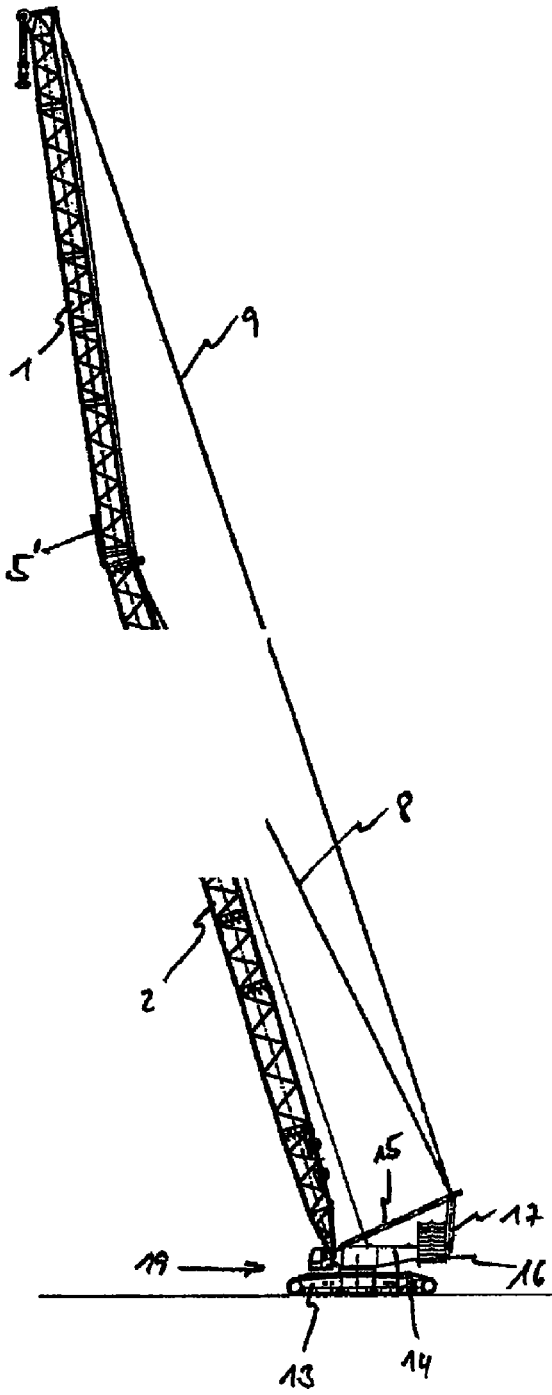
FIG. 3*e* shows the main boom of FIG. 3*a* in a nearly stretched position.
Figure 3F:
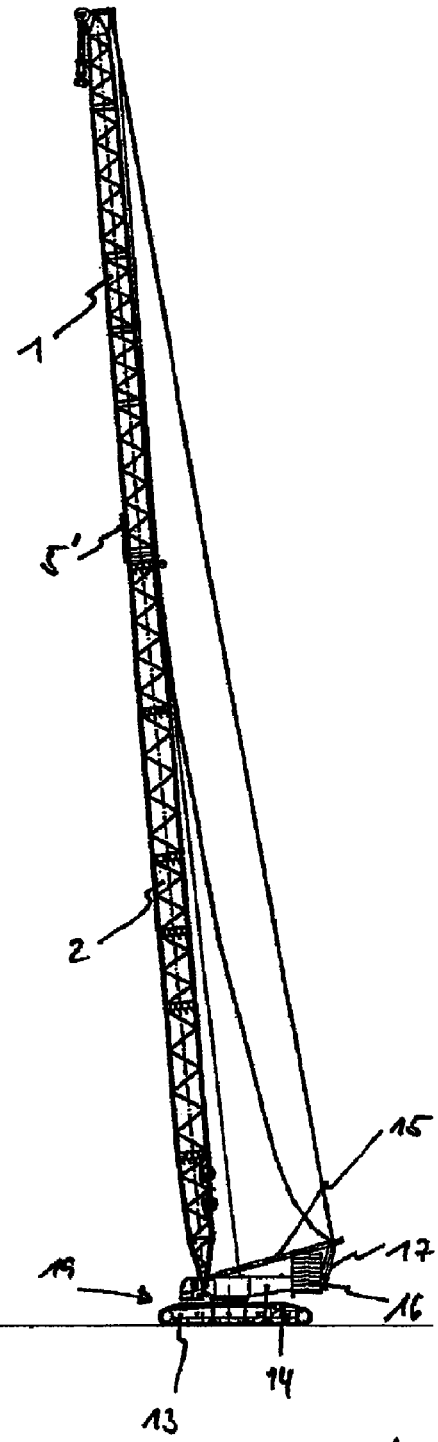
FIG. 3*f* shows the main boom of FIG. 3*a* in a crane operating position.

According to FIG. 3*d*, the lower boom portion is in a further lifted position, which has been effected by further activating of the hoist 17. Comparing the angle position of the upper boom portion 1 in FIGS. 3*c* and 3*d*, it can be seen that the angle has not changed or only negligibly with respect to the horizontal plane. This is achieved due to the fact that during the erection of the lower boom portion 2, the piston cylinder unit 5' is drawn in successively. Immediately before the two boom portions according to FIG. 3*e* have reached the stretched boom position, the upper retaining cable 9 is stretched such that the lower retaining cable 8 will become loose. Now, the main boom can be bolted at bolting point B and the crane is ready to be operated (FIG. 3*f*).

Figure 4A:
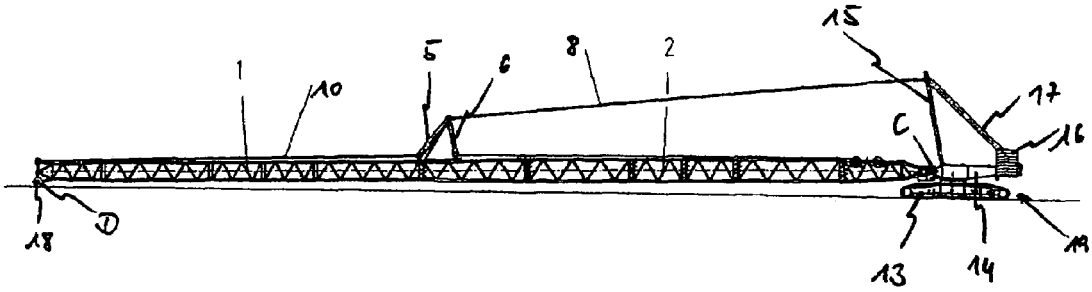
FIG. 4*a* is a view of a third embodiment of a mobile lattice-boom crane with a main boom in a starting position, which can be erected using the method according to the invention.
Figure 4B:
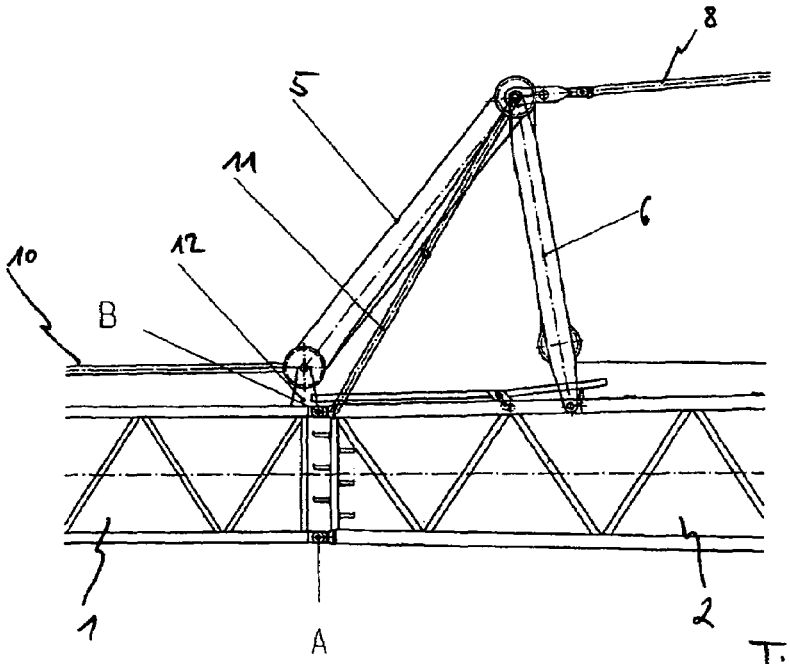
FIG. 4*b* is a detail of the main boom of FIG. 4*a* in a transitional zone between the lower and the upper boom portion.

A yet further possibility for erecting a main boom 1, 2 using the method according to the invention should be explained in the following: FIG. 4*a* again shows the starting position in which the boom portions 1, 2 are supported on a first support point C on the upper carriage 14 (hinge point) and a second support point D on the ground. At the upper end of the lower boom portion 2, a lower support 6 is arranged, which on one hand is stretched towards the boom via the restraint 11 and on the other hand via the retaining cable 8 via the tension support 15. Further, the tip of the support 6 is stretched via hoist 5 in connection with an upper retaining cable 10 towards the boom tip.

Figure 4C:
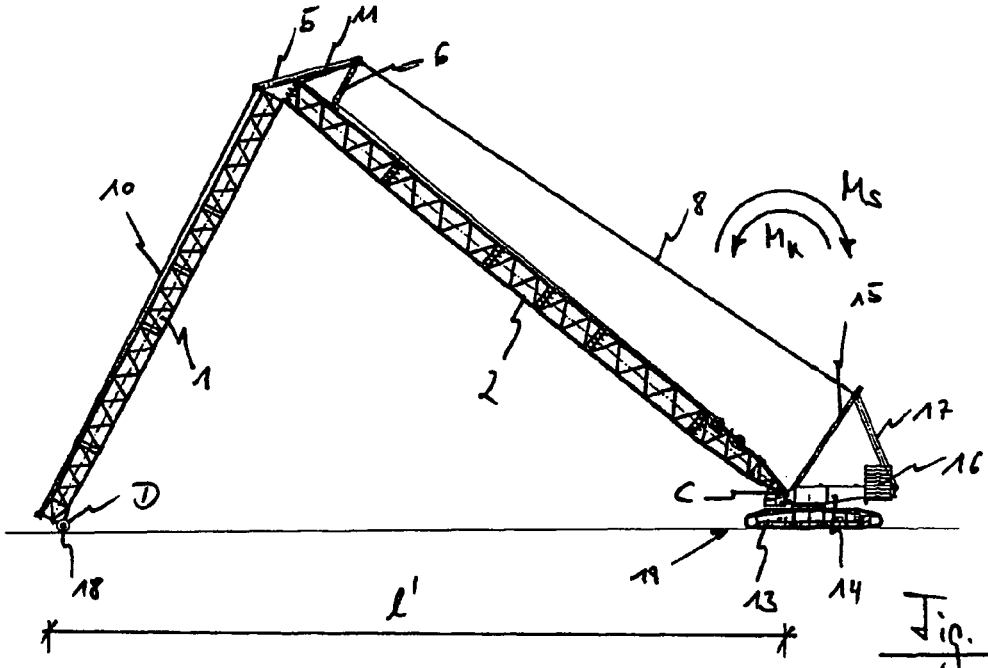
FIG. 4*c* shows the main boom of FIG. 4*a* in an angled position with a second support point.

In the starting position all restraints 11 and retaining cables 8, 10 are in a loose state. For shortening the effective lever arm 1', the hoist 17 is activated, whereby a tension force is applied to the upper retaining cable 8 and the restraint 11 such that the lower boom portion 2 starts to lift (FIG. 4*c*). By lifting the lower boom portion 2, the upper boom portion in turn is caused to lift also whereby the boom tip is moved towards the hinge point C at the upper carriage 14.

Figure 4D:
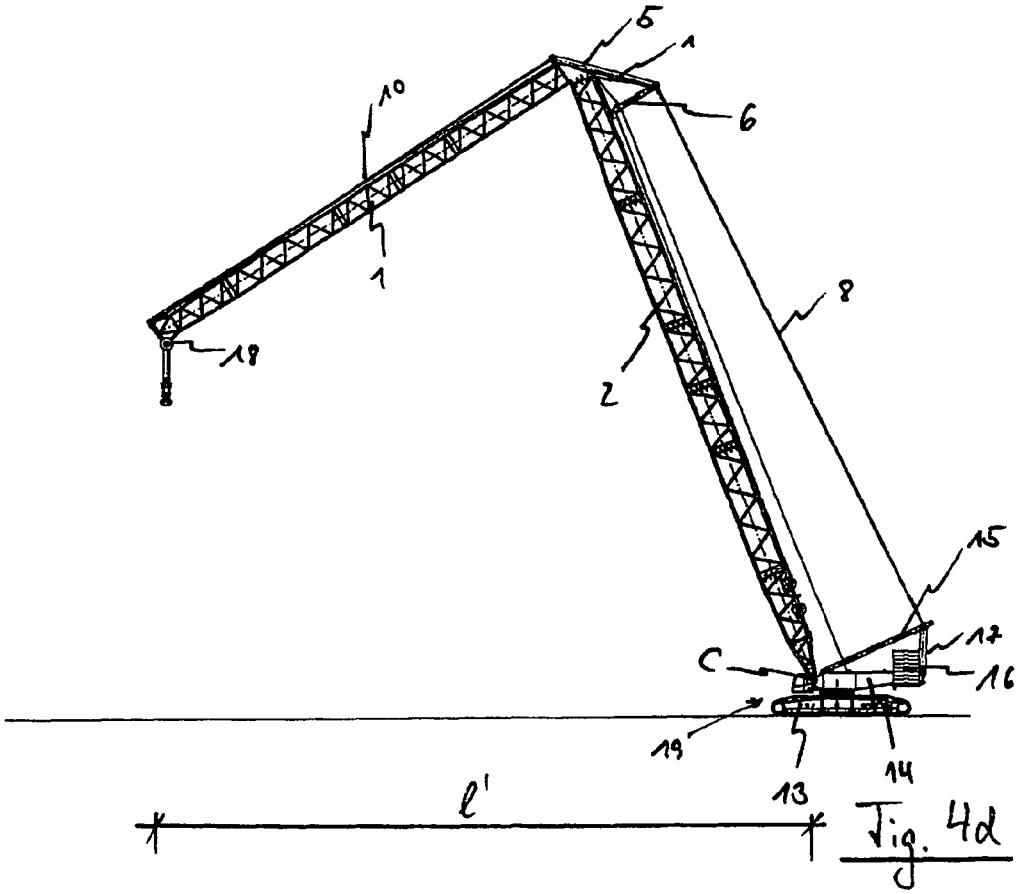
FIG. 4*d* shows the main boom of FIG. 4*a* in an angled position without a second support point.
Figures 4E, 4F:
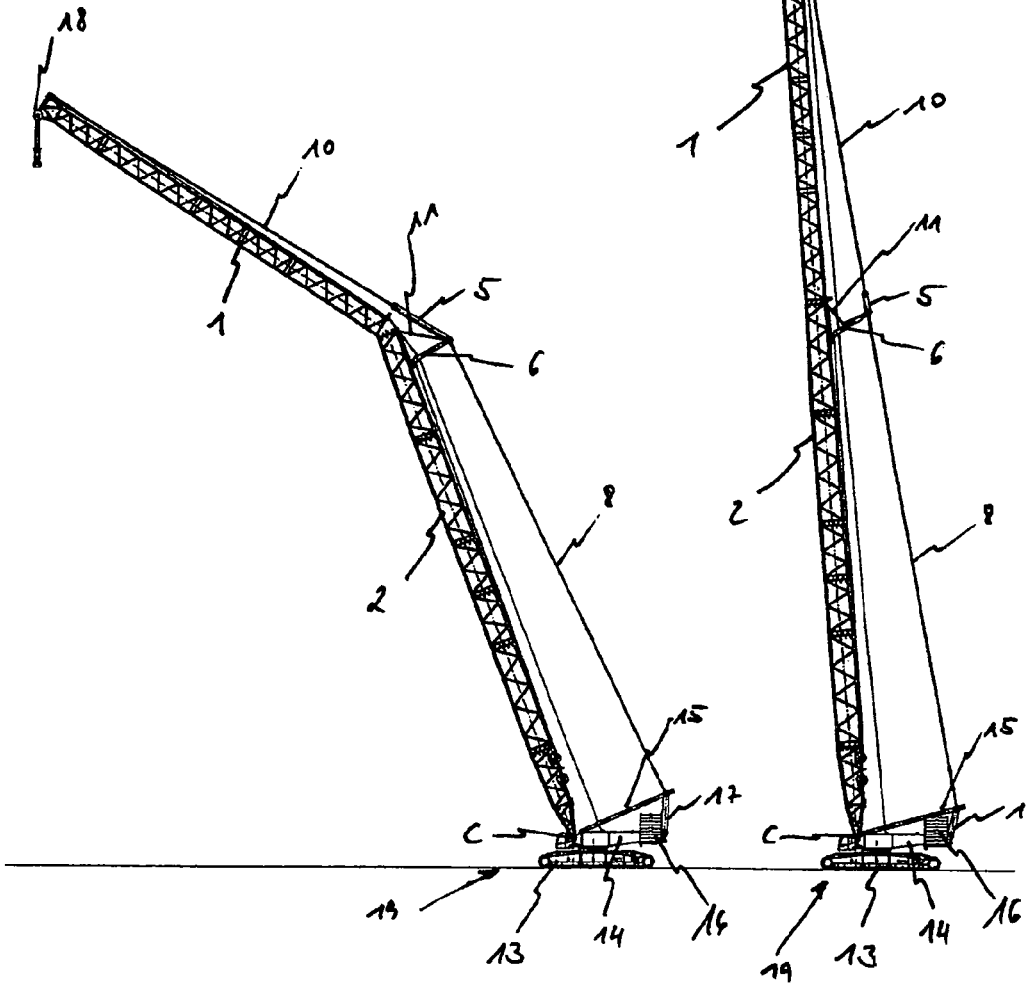
FIG. 4*e* shows the main boom of FIG. 4*a* in a nearly stretched position.
FIG. 4*f* shows the main boom of FIG. 4*a* in a crane operating position.

Assuming again that the position illustrated in FIG. 4*c* is the position in which the tilting moment $M_K$ producible by the main boom 1, 2 is equal to the standing moment $M_S$, then at the earliest in this position the hoist 5 being loose to that point can be locked or activated, respectively. As after the locking or activating of the hoist 5, respectively, it is continued to shorten hoist 17, then the angled main boom 1, 2 are further lifted (FIG. 4*d* ) altogether. At the latest when the lower boom portion 2 has reached the inclined position, the hoist 5 can be activated whereby the entire main boom 1, 2 is brought into the stretched position according to FIG. 3*f*. In this position the two boom portions 1, 2 can be bolted at the bolting point B to a unitary rigid main boom. After closing the main boom, the hoist 5 can be further shortened such that the restraint 11 will become loose. The two retaining cables 8 and 10 can be bolted to each other, to release the hoist 5 during crane operation.

At this point it should be noted again that the main boom can be disassembled on the basis of the principle according to the invention. In this case, the inventive steps have to result substantially in opposite sequence and in an accordant opposite movement direction.

The invention claimed is:

1. Method for erecting a lattice main boom of a lattice-boom crane subdivided into at least two lattice main boom portions, including a lower lattice main boom portion hinged to an upper carriage of the crane at a hinge point, and an upper lattice main boom portion, connected during assembly by a connection to the lower lattice main boom portion and connected during crane operation to the lower lattice main boom portion to form a unitary rigid lattice main boom, comprising:

producing a starting position, in which the lattice main boom attached to the upper carriage of the crane is supported on at least one second point on the ground spaced apart from the upper carriage, the lattice main boom being assembled to a greatest in-use length;

shortening the effective lever arm of the lattice main boom by producing an angle position between the lower and the upper lattice main boom portions to decrease a tilting moment producible by a lattice main boom weight;

maintaining the second support point until the tilting moment producible by the lattice main boom weight is smaller than a standing moment of the crane;

concurrently lifting both of the angled lower and upper lattice main boom portions by pivoting around the hinge point on the upper carriage of the crane;

aligning to the greatest in-use length the lower and upper lattice main boom portions into a crane operating position; and after aligning the lower and upper lattice main boom portions, establishing a rigid connection between the lower and the upper lattice main boom portions.

2. The method according to claim 1, wherein the angle position between the lower and the upper lattice main boom portions is produced whereby a lattice main boom tip is caused to move towards the hinge point on the upper carriage of the crane, maintaining the at least one second support point.

3. The method according to claim 2, wherein the lower lattice main boom portion is erected in that a traction force is produced in a lower retaining cable, tensioning the lower lattice main boom portion towards the upper carriage of the crane.

4. The method according to claim 2, wherein for supporting the movement of the lattice main boom tip, at least one of a roller and a sliding element is arranged on the lattice main boom tip.

5. The method according to claim 1, wherein the angle position between the upper lattice main boom portion and a horizontal plane is maintained substantially with at least an element to provide at least one of traction or pressure during lifting of the angled lower and upper lattice main boom portions, coupling the lower and the upper lattice main boom portions to each other kinematically.

6. The method according to claim 5, wherein the angle position between the lower and the upper lattice main boom portions is maintained substantially with a hoist.

7. The method according to claim 5, wherein the angle position between the lower and the upper lattice main boom portions is maintained substantially with the element, the element being effective for force transmission between a support arranged on the lower lattice main boom portion and a support arranged on the upper lattice main boom portion, which in turn is stretched towards a lattice main boom base and towards a lattice main boom tip, respectively.

8. The method according to claim 5, wherein the angle position between the lower and the upper lattice main boom portions is maintained substantially with the element, the element being effective for force transmission between a support arranged on the lower lattice main boom portion, being stretched towards the upper carriage, and a lattice main boom tip.

9. The method according to claim 5, wherein, when the tilting moment producible by the lattice main boom weight is smaller than the standing moment of the crane, the element is locked or activated and thus, the angle position between the lower and the upper lattice main boom portions is kept substantially constant during further erection procedure, whereby, during the further erection procedure, ground contact of a lattice main boom tip of the upper lattice main boom portion is lost.

10. The method according to claim 5, wherein after reaching a rise position of the lower lattice main boom portion, the upper lattice main boom portion is brought into a stretched boom position by activating the traction element, and there is a rigid connection to the lower lattice main boom portion.

11. The method according to claim 10, wherein the rigid connection of the lower and the upper lattice main boom portions results from bolting.

12. The method according to claim 10, wherein after producing the rigid connection by further activation of the traction element, tension is applied to the lattice main boom.

13. The method according to claim 5, wherein the angle position between the upper lattice main boom portion and the horizontal plane is maintained substantially with a piston cylinder unit.

14. The method according to claim 5, wherein the pressure element is effective for force transmission between the lower and the upper lattice main boom portions.

15. The method according to claim 5, wherein the angle position between the lower and the upper lattice main boom portions is produced in that the upper lattice main boom portion is erected by means of the pressure element, whereby a lattice main boom tip is caused to move towards the hinge point on the upper carriage of the crane.

16. The method according to claim 5, wherein, when the tilting moment producible by the lattice main boom weight is smaller than the standing moment of the crane, the lower lattice main boom portion is erected, losing the second support point.

17. The method according to claim 16, wherein the erecting of the lower lattice main boom portion is carried out with a retaining cable, stretching the lower lattice main boom portion towards the upper carriage.

18. The method according to claim 16, wherein during erecting the lower lattice main boom portion, the upper lattice main boom portion simultaneously is maintained in a substantially constant angle to a horizontal plane.

19. The method according to claim 1, wherein after reaching a desired position of the lower lattice main boom portion, the upper lattice main boom portion is brought into a straightened boom position, and there is a rigid connection to the lower lattice main boom portion.

20. The method according to claim 19, wherein after reaching the straightened boom position, the lattice main boom is held by a retaining cable in this position, stretching the upper lattice main boom portion towards the upper carriage.

21. The method according to claim 20, wherein after reaching the straightened boom position, the lower and the upper lattice main boom portions are connected to each other rigidly.

22. The method according to claim 21, wherein the rigid connection of the lower and the upper lattice main boom portions results from bolting.

23. The method according to claim 19, wherein after producing the rigid connection by further activation of the element, tension is applied to the lattice main boom.

24. Method for dismantling a lattice main boom for a lattice-boom crane with a lower lattice main boom portion hinged to an upper carriage of the crane at a first hinge point and an upper lattice main boom portion connected during assembly by a connection to the lower lattice main boom portion and connected during crane operation to the lower lattice main boom portion to form a unitary rigid lattice main boom, comprising:

relaxing the rigid connection between the lower and upper lattice main boom portions, the lattice main boom being in a greatest in-use length;

producing an angle position from a crane operating position between the lower and the upper lattice main boom portions to shorten the effective lever arm of the lattice main boom and to decrease a tilting moment producible by a lattice main boom weight, according to which the tilting moment producible by the boom weight maximally corresponds to a standing moment of the crane;

concurrently lowering both of the angled lattice main boom portions by pivoting around the first hinge point on the upper carriage of the crane, considering the tilt condition, until the lattice main boom is supported on at least a second point on the ground; and stretching the lattice main boom to the greatest in-use length, maintaining the second support point.

* * * * *